US009021663B2

(12) United States Patent
Maudsley

(10) Patent No.: US 9,021,663 B2
(45) Date of Patent: May 5, 2015

(54) FOREARM APPARATUS FOR SUPPORTING A CARGO HANDLE

(71) Applicant: Kirk Maudsley, Providence, UT (US)

(72) Inventor: Kirk Maudsley, Providence, UT (US)

( * ) Notice: Subject to any disclaimer, the term of this patent is extended or adjusted under 35 U.S.C. 154(b) by 0 days.

(21) Appl. No.: 14/211,370

(22) Filed: Mar. 14, 2014

(65) Prior Publication Data

US 2014/0259536 A1 Sep. 18, 2014

Related U.S. Application Data

(60) Provisional application No. 61/788,614, filed on Mar. 15, 2013.

(51) Int. Cl.
*B25G 1/10* (2006.01)
*A45F 5/10* (2006.01)

(52) U.S. Cl.
CPC ..... *A45F 5/10* (2013.01); *Y10T 16/476* (2015.01); *Y10T 29/49716* (2015.01); *A45F 5/102* (2013.01); *Y10S 16/901* (2013.01)

(58) Field of Classification Search
USPC ..... 16/430, 901, DIG. 12; 2/59; 297/183.1
See application file for complete search history.

(56) References Cited

U.S. PATENT DOCUMENTS 3,189,073 A * 6/1965 Todd ..... 224/222
4,120,052 A * 10/1978 Butler ..... 2/16
D300,676 S * 4/1989 Pierce, Jr. ..... D29/120.1
5,324,094 A 6/1994 Kain
5,379,758 A * 1/1995 Snyder ..... 600/213
D364,008 S * 11/1995 Florio ..... D29/120.1
5,516,190 A 5/1996 Kain et al.
5,651,581 A 7/1997 Myers et al.
5,658,044 A 8/1997 Krevh
5,716,087 A * 2/1998 Backich et al. ..... 294/176
5,865,775 A * 2/1999 Peoples et al. ..... 602/20
6,240,565 B1 * 6/2001 Spear ..... 2/158
6,626,489 B2 9/2003 Geis et al.
6,913,313 B2 7/2005 Sedlack
7,270,372 B2 9/2007 Robertson
7,850,233 B2 12/2010 Shafer et al.
7,900,269 B2 * 3/2011 Morrow et al. ..... 2/16
7,976,100 B2 7/2011 Chen et al.
8,033,599 B2 10/2011 Meeker et al.
2012/0175920 A1 * 7/2012 Carbone ..... 297/183.1
2014/0259535 A1 * 9/2014 Owens et al. ..... 16/430

* cited by examiner

*Primary Examiner* — Roberta Delisle
(74) *Attorney, Agent, or Firm* — Kunzler Law Group, PC

(57) ABSTRACT

Described herein is an apparatus that rests on a forearm of a user and supports a cargo handle is described. A longitudinal axis of the forearm extends in a first direction and the cargo handle extends in a second direction substantially perpendicular to the first direction. The apparatus includes a base member that is positionable between the cargo handle and forearm. Additionally, an upper surface is defined by the base member where the upper surface includes a handle reception recess. Further, a lower surface is defined by the base member where the lower surface is curved about an axis that is substantially parallel to the first direction when engaged with the forearm of the user.

20 Claims, 7 Drawing Sheets

FOREARM APPARATUS FOR SUPPORTING A CARGO HANDLE

CROSS-REFERENCE TO RELATED APPLICATION

This application claims the benefit of U.S. Provisional Patent Application No. 61/788,614, filed Mar. 15, 2013, which is incorporated herein by reference.

FIELD

The present disclosure relates generally to cargo carrying apparatus, and more specifically to an apparatus that facilitates carrying cargo by a handle using a forearm of a user.

BACKGROUND

Most items that are designed to be toted by users include some type of handle, grasp, strap, or handgrip. For example, purses, handbags, briefcases, infant carriers, backpacks, coolers, luggage, and other cargo items usually have a component that facilitates a user's ability to lift, carry, haul, hoist, and otherwise move the cargo item. For example, many cargo items include a shoulder strap for supporting the cargo load and for distributing the cargo's weight across the user's back or shoulders. Such straps are especially useful when carrying heavier items.

Certain cargo items, however, such as conventional coolers and infant carriers, often do not include a shoulder strap or other weight distributing member. This may be due, at least in part, to the nature of the contents of such items. For example, it would be impractical and unsafe for a user to merely sling the handle of a conventional infant carrier over the shoulder and haul the infant around in such a manner. Similarly, throwing the handle of a conventional cooler over the shoulder and transporting it would likely damage the contents of the cooler and/or spill the food and beverages contained therein. In other words, some cargo items only include handles or handgrips and are intended to be carried by hand and are not designed for use with shoulder straps and other conventional weight distributing components.

However, many users have adapted to these circumstances by hanging such cargo items on their forearms, either in an attempt to multi-task or to partially transfer a fraction of the weight of the cargo item onto the user's hip or onto the user's opposite arm by reaching across the body with the opposite arm to grasp the handle of the cargo item. Regardless of a user's ability to transfer or distribute weight in this manner, the downward force applied on a user's forearm can often be considerable. The handles on such items are not particularly designed to comfortably or safely engage a user's forearm. Repeated and/or long-term hauling of such cargo items on a user's forearm, specifically heavier cargo items, can cause damage to the forearm and may result in muscle injuries and bruising.

SUMMARY

From the foregoing discussion, it should be apparent that a need exists for an apparatus that facilitates users carrying cargo items on their forearms. The subject matter of the present disclosure has been developed in response to the present state of the art, and in particular, in response to the problems and needs in the art that have not yet been fully solved by currently available cargo handles. Accordingly, the present disclosure has been developed to provide an apparatus for supporting a cargo handle on a user's forearm that overcomes many or all of the above-discussed shortcomings in the art.

According to one embodiment, an apparatus that rests on a forearm of a user and supports a cargo handle is described. A longitudinal axis of the forearm extends in a first direction and the cargo handle extends in a second direction substantially perpendicular to the first direction. The apparatus includes a base member that is positionable between the cargo handle and forearm. Additionally, an upper surface is defined by the base member where the upper surface includes a handle reception recess. Further, a lower surface is defined by the base member where the lower surface is curved about an axis that is substantially parallel to the first direction when engaged with the forearm of the user.

In some implementations of the apparatus, the lower surface includes a lining material. The lining material can be a cushioning material in certain implementations. According to some implementations, the lower surface is elongate in a direction parallel to the axis According to certain implementations of the apparatus, the handle reception recess includes at least one of a grip-enhancing material and grip-enhancing features. The handle reception recess can be contoured to receive and retain the cargo handle.

In certain implementations, the apparatus also includes a proximal vertical surface that is defined by the base member. The proximal vertical surface can be curved about an axis parallel to a longitudinal axis of an upper arm of the user coupled to the forearm of the user. In yet some implementations, the proximal vertical surface further includes a lining material.

In yet some implementations, the apparatus further includes a securing member that is coupled to the base member. At least a portion of the securing member spans over the upper surface of the base member. In some implementations, the securing member includes means for releasably securing the securing member to the cargo handle. In yet some implementations, the base member and the securing member include means for releasably securing the apparatus about the cargo handle. According to certain implementations, the securing member includes at least one of a grip-enhancing material and grip-enhancing features. According to yet some implementations, the securing member includes a first end that is rotatably coupled to the base member and a second end that is detachably coupleable to the base member. The securing member includes a handle extending at least partially across the handle reception recess in some implementations. In some implementations, the securing member can include a strap with a first end portion coupled to the base member at a first location and a second end portion removably coupled to the base member at a second location, where the first and second locations are on opposing sides of the handle reception recess. The apparatus can be integrated into the cargo handle to form a one-piece monolithic construction with the cargo handle in certain implementations. The apparatus may further include a user handle that extends from the base member.

According to yet another embodiment, an apparatus is described that rests on the forearm of a user and supports a cargo handle. A longitudinal axis of the forearm extends in a first direction and the cargo handle extends in a second direction substantially perpendicular to the first direction. The apparatus includes a base member that is positionable between the cargo handle and forearm. An upper surface defined by the base member includes a handle reception recess. A lower surface defined by the base member is curved about an axis that is substantially parallel to the first direction when engaged with the forearm of the user. A proximal vertical surface defined by the base member also is curved, but about an axis that is substantially parallel to a longitudinal axis of an upper arm coupled to the lower arm of the user when engaged with the upper arm of the user. The apparatus further includes a securing member that is attached to the base member. At least a portion of the securing member is elevated above the upper surface of the base member by at least a thickness of the cargo handle.

In some implementations of the apparatus, the securing member rotates relative to the base member to secure the cargo handle between the securing member and the handle reception recess.

In yet another embodiment, a method for retrofitting a cargo handle to be carried by a forearm of a user includes providing a forearm apparatus. The forearm apparatus includes a base member with an upper surface that defines a handle reception recess and a lower surface that defines a forearm reception recess. The handle reception recess is contoured to receive the cargo handle and the forearm reception recess is contoured to receive the forearm of a user. The apparatus can further include a clamping member that is movably coupled to the base member. The method additionally includes removably securing the forearm apparatus to the cargo handle by positioning the cargo handle onto the handle reception recess and moving the clamping member to clamp the cargo handle between the clamping member and the handle reception recess.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the disclosure will be readily understood, a more particular description of the disclosure briefly described above will be rendered by reference to specific embodiments that are illustrated in the appended drawings. Understanding that these drawings depict only typical embodiments of the disclosure and are not therefore to be considered to be limiting of its scope, the subject matter of the present application will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Figure 1:
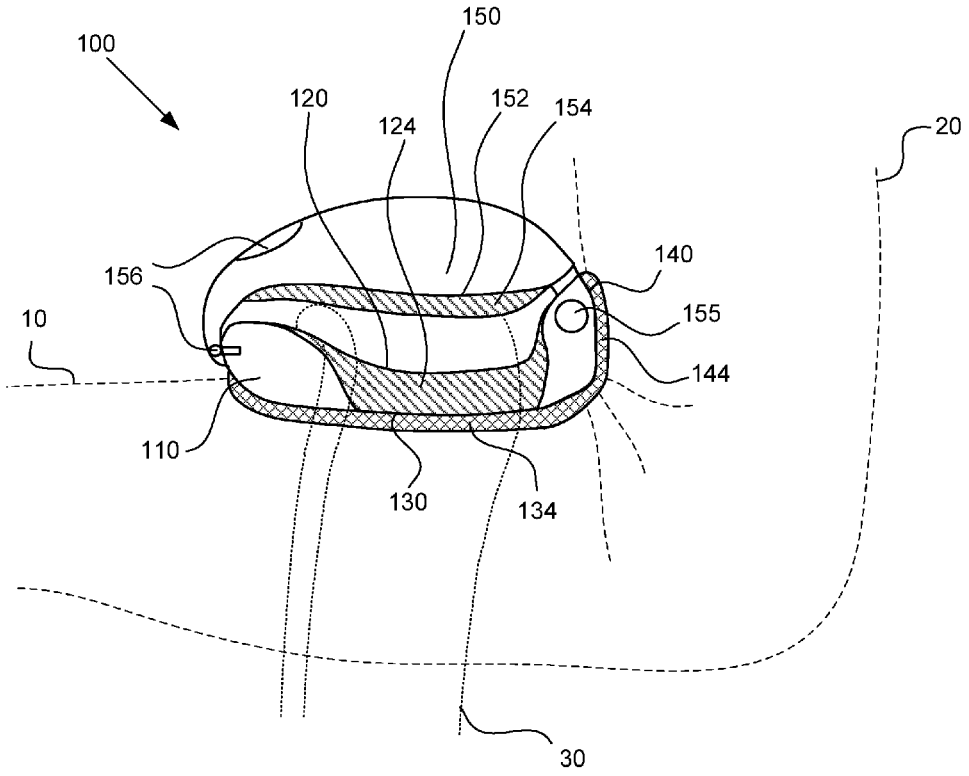
FIG. 1 is a side view illustrating one embodiment of an apparatus for supporting a cargo handle on the forearm of a user.

FIG. 1 is a side view illustrating one embodiment of an apparatus 100 for supporting a cargo handle 30 on the forearm 10 of a user. The cargo handle 30 can be part of any of various cargo items that carry, support, or contain any of various cargo. For example, in some implementations, the cargo items can include, among other cargo items, purses, handbags, briefcases, infant carriers, backpacks, coolers, and luggage. In one specific implementation, the cargo item is an infant carrier and the cargo can be an infant. As described above in the Background section, many cargo items are not designed specifically to be comfortably supported on a user's forearm. Nevertheless, users frequently haul such items by inserting the forearm into or under the handgrip and allowing the weight of the item to be supported by the forearm. While such a maneuver may be more convenient than, or may alleviate some of the strain involved with, carrying items in other manners, the interaction of the handle resting on the forearm is uncomfortable and may result in pain and injury. Accordingly, the apparatus of the present disclosure includes various components that facilitate the ability of a user to increase comfort when carrying cargo items on the forearm.

The apparatus 100 in FIG. 1 includes a base member 110 resting on the forearm 10 of a user. The base member 110 is configured to support a handle 30 of a cargo item. The base member 110 defines an upper surface 120 for supporting the cargo handle 30, a lower surface 130 for engaging the forearm 10 of a user, and a proximal vertical surface 140 for engaging the upper arm 20 of a user. The apparatus 100 also includes a securing member 150 (e.g., clamping member) that is coupled to the base member 110. The upper surface 120 of the base member 110 may include a material 124 that enhances and facilitates engagement between the handle 30 and the base member 110. Additional details relating to the upper surface 120 are included below with reference to FIG. 2. The lower surface 130 of the base member 110 may include a lining material 134 that enhances and facilitates engagement between the forearm 10 of the user and the base member 110. The proximal vertical surface 140 may also include a lining material 144. Additional details relating to the lower surface 130 and the proximal vertical surface 140 are included below with reference to FIG. 2. The securing member 150 may include an underside 152 with a material 154, hinge assembly 155, and fastening member 156. Details relating to various components and embodiments of the securing member 150 are included below with reference to FIGS. 2 and 4-7.

Throughout the present disclosure, the term "forearm" 10 will be used to reference the portion of the arm that is between the elbow and the wrist and the term "upper arm" 20 will be used to reference the portion of the arm that is between the elbow and the shoulder. Generally users carry items on the forearm 10 in close proximity to the elbow with the elbow bent at an angle (i.e., the angle between the forearm 10 and the upper arm 20) of about ninety degrees as depicted. However, it is contemplated that the apparatus 100 may be positioned at different locations along the length of the forearm 10 and that the angle between the forearm 10 and the upper arm 20 may vary depending on the specifics of a given implementation.

The apparatus 100 may also vary in overall size depending on the specifics of a given implementation. For example, the apparatus 100 may be sized according to the weight of the cargo and/or the size (see FIG. 3) of the cargo handles. If the cargo item includes multiple handles or is especially heavy, the apparatus 100 may be configured to substantially span the length and width of the forearm of the user, thereby dispersing the weight of the cargo across a larger surface. In one embodiment, the length of the apparatus 100 in the first direction 11 is between about 1 inch and about 12 inches. In another embodiment, the length of the apparatus 100 in the first direction 11 is between about 2 inches and about 8 inches. In yet another embodiment, the length of the apparatus 100 in the first direction 11 is between about 3 inches and about 5 inches. The width of the apparatus 100 in the second direction 12, independent of the actual length of the apparatus 100, may have dimensions similar to the embodiments disclosed above with reference to the length of the apparatus. The various components of the apparatus 100 may be constructed out of plastics, polymer compounds, metals, rubbers, textiles, and cushioning padding.

Figure 2:
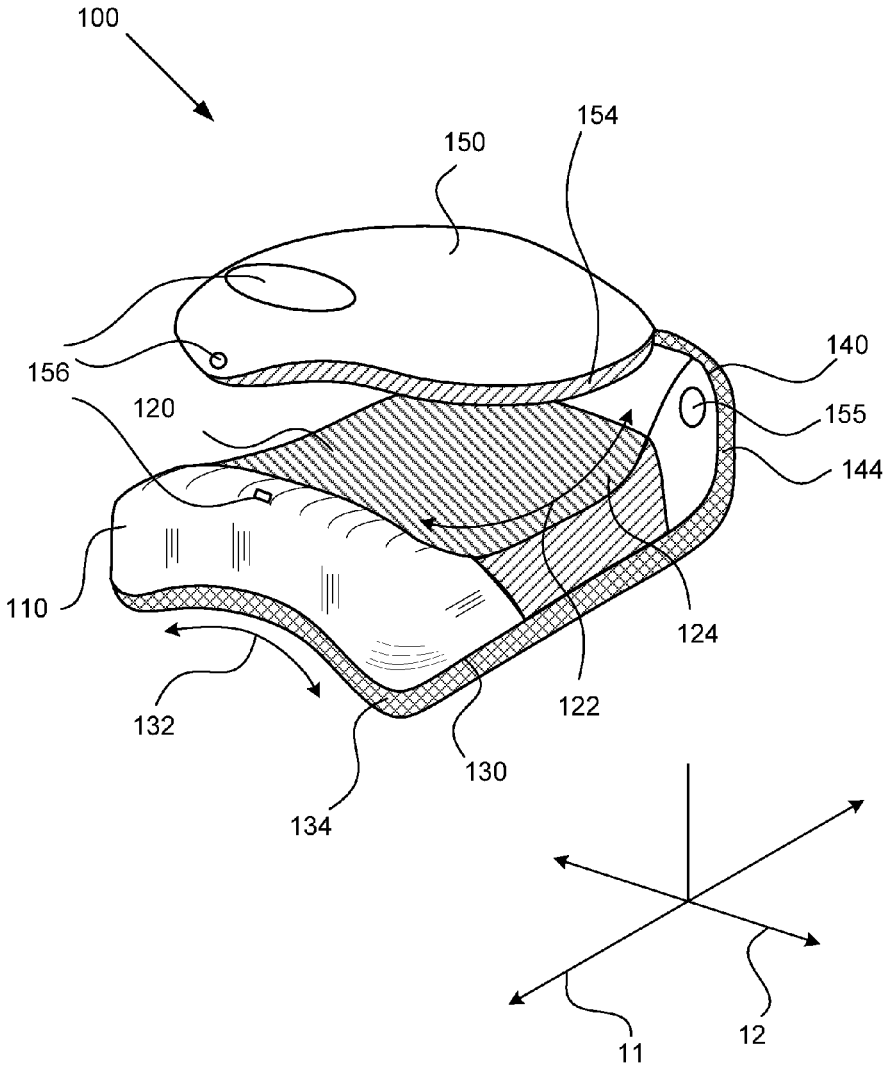
FIG. 2 is a perspective view of the apparatus of FIG. 1, according to one embodiment.

FIG. 2 is a perspective view of the apparatus 100 of FIG. 1, according to one embodiment. Also depicted in FIG. 2 are directional arrows 11, 12 that represent a first direction 11 and a second direction 12. Throughout the present disclosure, the term "first direction" 11 will be used to reference the direction parallel with a longitudinal axis of the forearm of a user (no forearm is depicted in FIG. 2 to avoid obscuring the perspective view of the apparatus 100). The term "second direction" 12 will be used throughout the disclosure to reference the direction perpendicular to the first direction 11 and perpendicular to the longitudinal axis of the upper arm (no upper arm is depicted in FIG. 2 to avoid obscuring the perspective view of the apparatus 100).

The upper surface 120 of the base member 110 may include a handle reception recess 122 on which the cargo handle may be seated. The cargo handle, although not depicted in FIG. 2, traverses the upper surface 120 of the base member in the second direction 12 and engages the handle reception recess 122 of the upper surface 120 while the apparatus 100 is in use. The handle reception recess 122 may include a contoured (e.g., curved or notched) region of the upper surface 120 (as depicted). In other implementations, the handle reception recess 122 may include a substantially flat portion of the upper surface 120 designating an area where the cargo handle engages the upper surface 120 of the base member 110. In one embodiment, the length of the handle reception recess 122 in the first direction may be at least the width of the cargo handle (See FIG. 3 for dimensions of a cargo handle).

The upper surface 120 may also include a coating material 124 (e.g., grip-enhancing material) that enhances and facilitates the seating interaction (e.g., grip) between the cargo handle and the base member 110. In one embodiment, the coating material 124 may include a rubber substance that prevents the cargo handle from slipping in the first 11 or second direction 12 relative to the base member 110. In another embodiment, the coating material 124 may include a padding layer or a gel layer that partially contours and/or conforms to the cargo handle, thus increasing the static and sliding friction between the cargo handle and the upper surface 120, thereby decreasing the likelihood of slippage. In another embodiment, the coating material 124 may comprise a textile-type surface. It is contemplated that other materials and substances may be used as the coating material 124. Also contemplated, in some implementations, the upper surface 120 may include grip-enhancing features, such as a textured surface with a plurality of protrusions. As briefly described above with reference to FIG. 1, the overall length and width of the upper surface 120 may also be configured according to a specific type of cargo. For example, if the cargo being supported is a child in an infant carrier, the upper surface 120, the handle reception recess 122, and the coating material 124 may be selected and designed accordingly.

In one embodiment, base member also includes a lower surface 130 for engaging the forearm of a user. The lower surface 130 of the base member 110 may include a concave surface 132 for contouring to the forearm of a user. In other words, in one embodiment the lower surface 130 curves 132 about an axis parallel to the first direction 11. The degree of curvature may depend on the specifics of a given implementation. For example, the curvature 132 may depend on the width and girth of the forearm of a user or may depend, in part, on the type and weight of the cargo being supported.

The base member 110 may also include a proximal vertical surface 140 for engaging the upper arm of the user. In one embodiment, the proximal vertical surface 140 may only extend a short distance up the upper arm when compared to the length of the base member 110 in the first direction. In another embodiment, the proximal vertical surface 140 may extend a comparatively longer distance up the upper arm. As described above, the angle between the proximal vertical surface 140 and the lower surface 130 of the base member may mirror the angle between the upper arm and the forearm of a user. In other words, depending on the carrying preferences of a user in terms of the angle of the elbow, it is contemplated that various angles and configurations between the various surfaces 120, 130, 140 fall within the scope of the present disclosure. Accordingly, in one embodiment (not depicted) the apparatus 100 may include a mechanism for changing the angle between the proximal vertical surface 140 and the lower surface 130, depending on the hauling preferences of a user.

In one embodiment, a lining material 134, 144 may cover the lower surface 130 and the proximal vertical surface 140. The lining material 134, 144 may increase the comfort a user experiences while hauling cargo by providing extra padding and generally dispersing the weight of the cargo handle. Similar to the coating material 124 described above with reference to the upper surface 120, the lining material 134, 144 may include a rubber substance that also prevents the slippage between the forearm of a user and the lower surface 130 and the proximal vertical surface 140. In another embodiment, the lining material 134, 144 may include a padding layer or a gel layer that partially contours and/or conforms to the forearm, thus increasing the static and sliding friction between the forearm and the surfaces 130, 140, thereby decreasing the likelihood of slippage. In another embodiment, a textile surface or a cushion may comprise the lining material 134, 144. It is contemplated that other materials and substances may be used as the lining material 134, 144.

In one embodiment, the apparatus 100 may also include a securing member 150 that is attached to the base member 110 and extends, at least partially, above the upper surface 120 of the base member 110. The securing member 150, generally and according to one embodiment, provides the apparatus 100 with a structure for capturing and/or securely receiving the cargo handle. In other words, the securing member 150 and the upper surface 120 of the base member 110 may, according to one embodiment, function to enclose the cargo handle. In such an embodiment, the apparatus 100 may be enclosed about the cargo handle for storage (i.e., when the user is not carrying the cargo).

FIG. 2 includes a depiction of a securing member 150 that includes a hinge assembly 155 and a fastening member 156. The hinge assembly 155 enables the securing member 150 to be rotatably coupled to the base member 110, thereby easily allowing a user to insert a cargo handle across the base member 110 in the second direction 12 and to subsequently close the securing member 150 on top of the cargo handle by rotating the securing member 150 about the hinge assembly 155. The securing member 150 may also include a fastening member 156 for temporarily attaching the securing member 150 to the base member 110 about the cargo handle. Depending on the size of the handle, the base member 110 may include notches that engage various rings or hooks on the securing member 150. For example, the securing member 150 may have a first end that is rotatably coupled to the hinge assembly 155 on the base member and a second end detachably fastened 156 to the base member 110 at a position a distance away from the hinge assembly 150, the position being across the handle reception recess 122 in the first direction 11 and the distance at least equal to the width of the cargo handle (See FIG. 3 for cargo handle dimensions). Throughout the present disclosure, the term "fastening member" 156 will be used in different embodiments and will include different structures and will involve different methods for connecting the securing member 150 to the base member 110 or to the cargo handle 30.

In one embodiment, the hinge assembly 155 may include components permanently attached to the base member 110 (e.g., hinge barrel) and components permanently attached to the securing member 150 (e.g., pins, pivots). The fastening member 156 may include a mechanism based on the tension between two components. For example, the fastening member 156 may include an edge permanently attached to the base member 110 and a second edge permanently attached to the securing member 150, whereby the two edges temporarily interlock with each other due to tension generated by a spring. Accordingly, the fastening member 156 may also include a release button that a user can press to disengage the interlocked surfaces. The securing member 150 may also include an underside that includes a coating material 154. The coating material 154 may include a rubber substance that prevents the cargo handle from slipping in the first 11 or second direction 12 relative to the base member 110. In another embodiment, the coating material 154 may include a padding layer or a gel layer that partially contours and/or conforms to the cargo handle, thus increasing the static and sliding friction between the cargo handle and the underside of the securing member 150, thereby decreasing the likelihood of slippage. In another embodiment, a textile surface may comprise the coating material 154. It is contemplated that other materials and substances may be used as a coating material 154.

Figure 3:
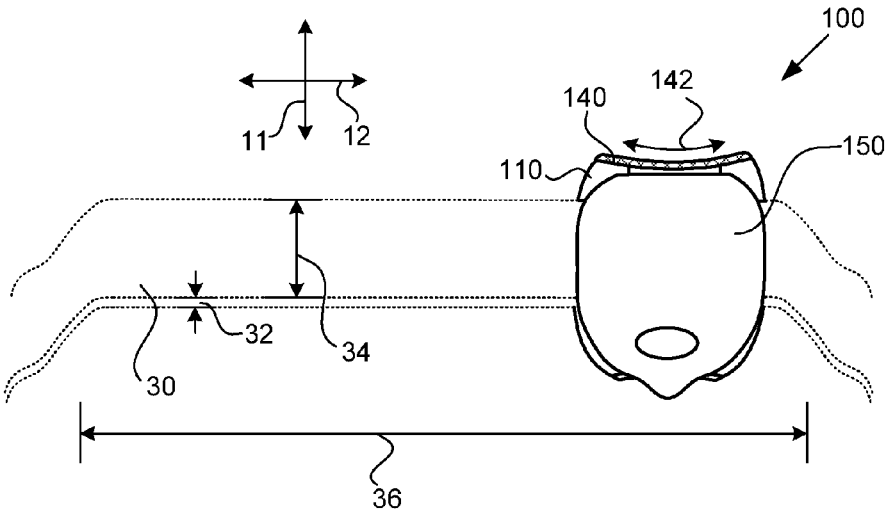
FIG. 3 is a top view of the apparatus of FIG. 1, according to one embodiment.

FIG. 3 is a top view of the apparatus 100 of FIG. 1, according to one embodiment. Also depicted in FIG. 3 are the directional arrows representing the first direction 11 and the second direction 12 introduced above with reference to FIG. 2. The cargo handle 30 includes a thickness 32, a width 34, and a length 36. The thickness 32 and width 34 of the cargo handle 30 influences the configuration of the securing member 150 and the base member 110. For example, if the cargo handle 30 has a thickness 32 of one inch and a width of three inches, the securing member 150 and the handle reception recess 122 of the upper surface 120 of the base member 110 should be designed to enclose such a cargo handle 30. It is also contemplated that the apparatus 100 may be located at various positions along the length 36 of the cargo handle 30, depending the on the preference of the user and the specifics of a given implementation. FIG. 3 also depicts the proximal vertical surface 140 having a concave curvature 142 for contouring the upper arm of a user. In other words, the proximal vertical surface 140 may curve 142 about an axis parallel to the longitudinal axis of the upper arm. The degree of curvature may depend on the specifics of a given implementation. For example, the curvature 142 may depend on the width and girth of the upper arm of a user or may depend, in part, on the type and weight of the cargo being supported.

Figure 4:
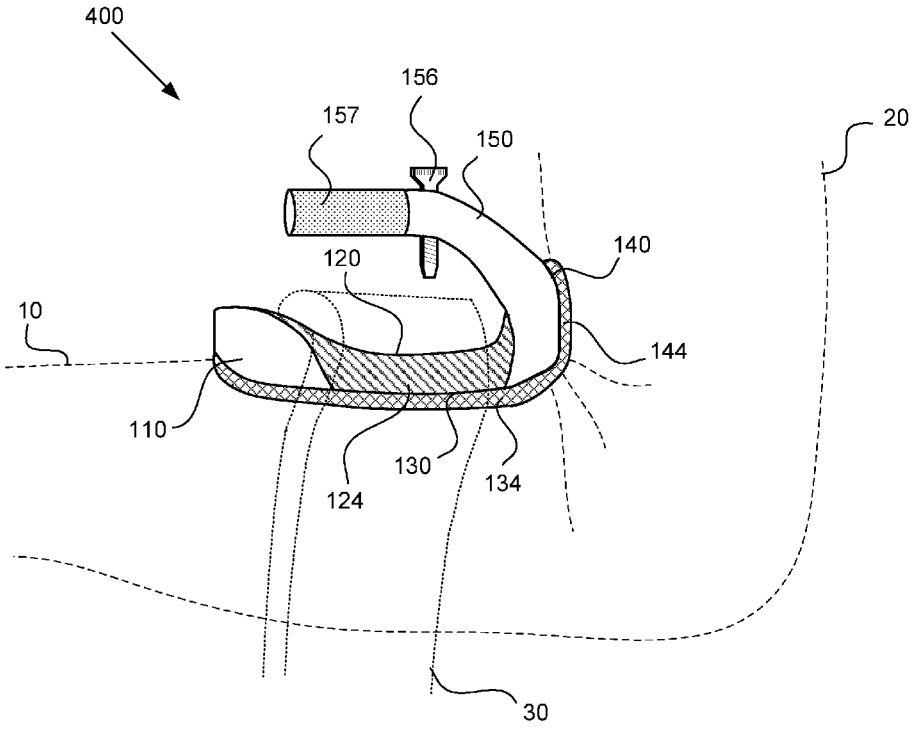
FIG. 4 is a side view illustrating another embodiment of an apparatus for supporting a cargo handle on the forearm of a user.

FIG. 4 is a side view illustrating another embodiment of an apparatus 400 for supporting a cargo handle 30 on the forearm 10 of a user. Some numbered elements depicted in FIG. 4 are not explicitly described below and were described above with reference to the previously presented Figures. Such elements are included in the present Figure for clarity in understanding the relative positions and configurations of the various components. The depicted apparatus 400 includes a securing member 150 and the securing member 150 includes a handle 157 and a fastening member 156. The handle 157 may be elevated above the cargo handle 30 and may at least partially extend across the base member 110 in the first direction 11. The handle 157 may include a gripping surface or structure that is ergonomically designed and the handle 157 may allow a user to provide additional support to the apparatus 100 by reaching across the body with the opposite arm and grasping the handle 157. In such a manner, the handle 157 may not only increase a user's ability resist the gravitational force on the cargo but may also allow a user to stabilize the apparatus 400 from lateral/horizontal movement relative to the forearm 10 of a user. Additionally, a securing member 150 with a handle 157 may facilitate a user's ability to initialize the operation of the apparatus 400 by providing a convenient lifting orientation. For example, a user may first engage the cargo handle 30 onto the upper surface 120 of the base member 110 before lifting and resting the apparatus 400 onto the forearm 10.

In the depicted embodiment, the fastening member 156 may include a device or a structure for connecting the securing member 150 to the cargo handle 30. The depicted embodiment includes a screw 156 passing through the securing member 150, whereby the screw 156 may be advanced downward to engage the cargo handle 30, thus locking or securing the cargo handle 30 in place. In another embodiment (not depicted), the fastening member 156 may include a ring or a buckle that swivels about a connection point on either the base member 110 or the securing member 150. The ring or buckle may be rotated about the connection point to engage a lip or an edge on the opposite component (base member 110 or securing member 150), thus temporarily enclosing or securing the cargo handle while hauling cargo items.

Figure 5:
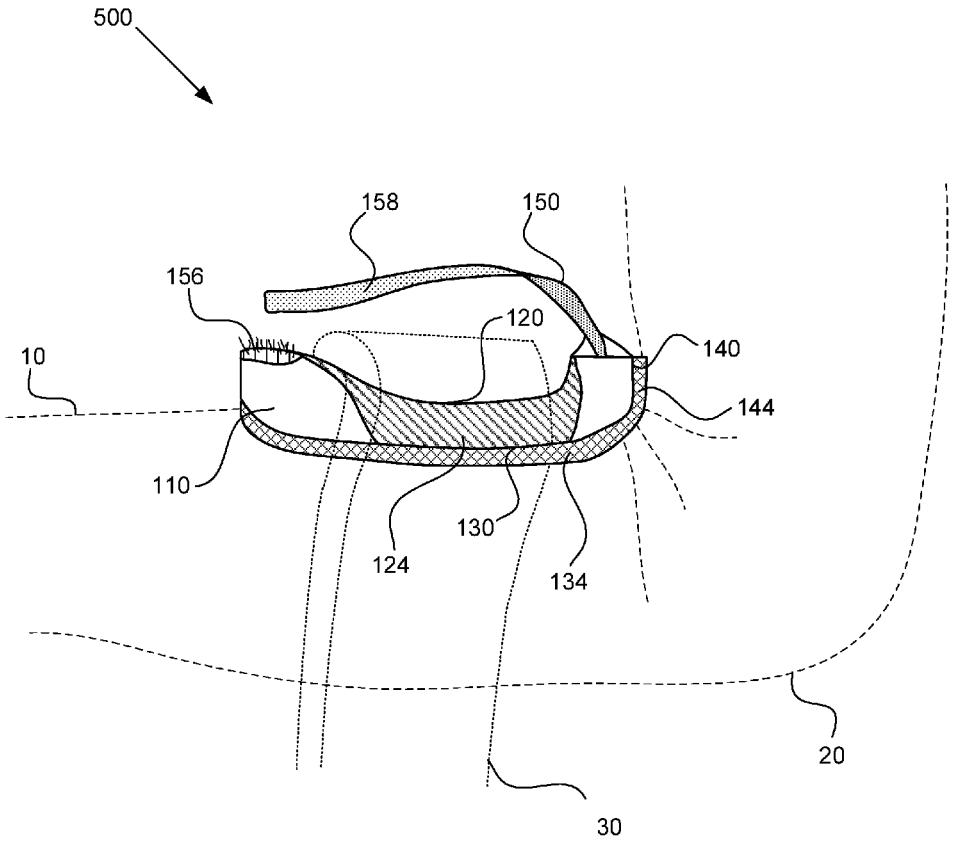
FIG. 5 is a side view illustrating another embodiment of an apparatus for supporting a cargo handle on the forearm of a user.

FIG. 5 is a side view illustrating another embodiment of an apparatus 500 for supporting a cargo handle 30 on the forearm of a user 10. Some numbered elements depicted in FIG. 5 are not explicitly described below and were described above with reference to the previously presented Figures. Such elements are included in the present Figure for clarity in understanding the relative positions and configurations of the various components. The depicted apparatus 500 includes a securing member 150 that includes a strap 158 that extends across the upper surface 120 of the base member 110 in the first direction. The strap may be permanently affixed to the base member 110 at one end and may be detachably coupled to the base member 110 at another end. The fastening member 156 may include a Velcro-type material affixed to the base member 150 that interacts with the material of the strap 158 to provide a temporary connection. The base member 110 may also include a steel ring or buckle through which a user may insert a strap in order to fasten the strap back onto the strap. In another embodiment and according to one example, a strap 158 may be detachably fastened to the base member 110 at a first and second location a distance away from each other, the first and second locations across the upper surface 120 in the first direction and the distance at least equal to the width (see FIG. 3) of the cargo handle 30.

Figure 6:
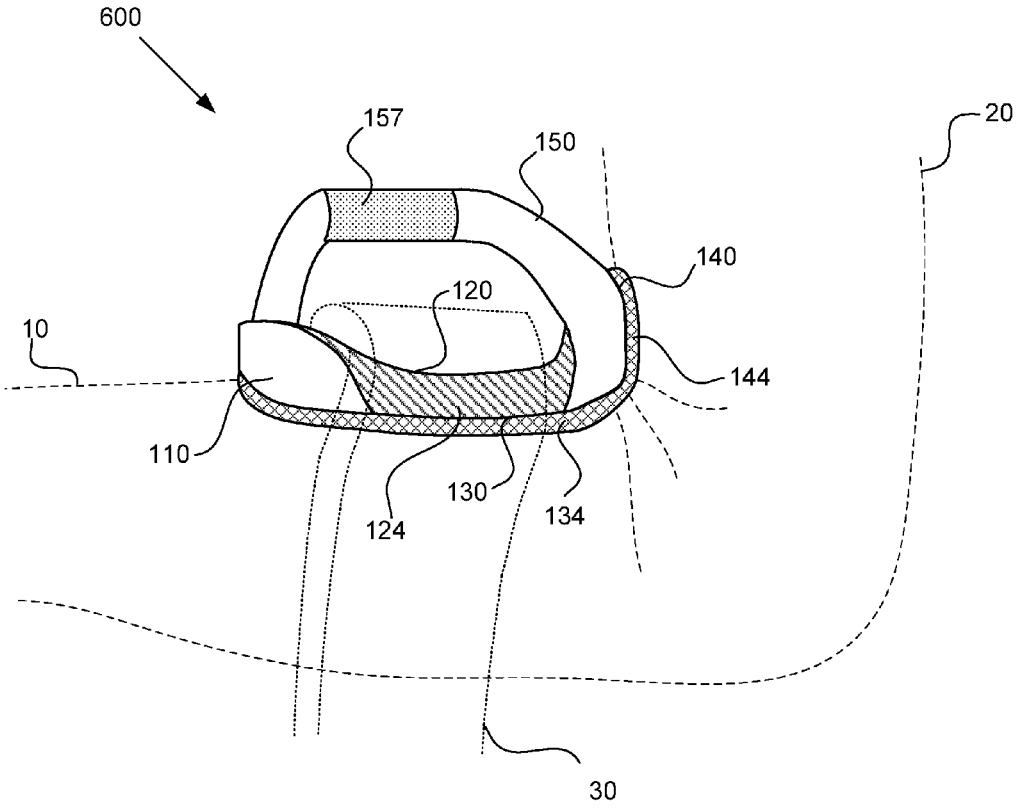
FIG. 6 is a side view illustrating another embodiment of an apparatus for supporting a cargo handle on the forearm of a user.

FIG. 6 is a side view illustrating another embodiment of an apparatus 600 for supporting a cargo handle 30 on the forearm 10 of a user. Some numbered elements depicted in FIG. 6 are not explicitly described below and were described above with reference to the previously presented Figures. Such elements are included in the present Figure for clarity in understanding the relative positions and configurations of the various components. The depicted apparatus 600 includes a securing member 150 that includes a handle 157 that is permanently affixed to the base member 110.

In some embodiments, the apparatus 600 may be designed and manufactured as an original component of the cargo item. For example, the apparatus 600 may be manufactured with an infant carrier to form a one-piece monolithic construction with the infant carrier. In one implementation, the handle 157 may be pre-installed about the cargo handle 30. In previous embodiments it has been contemplated that apparatus of the present disclosure may be used as a retro-fit application and may be implemented in various circumstances to existing support cargo items. However, the various embodiments of the present disclosure may comprise retro-fit installations or may comprise originally manufactured components accompanying the cargo item.

In such an embodiment, the handle 157 not only secures the cargo handle 30 in position while hauling the cargo on the forearm 10, the handle 157 also provides the user with an alternative orientation for holding the cargo handle 30 in the hand. In other words, the cargo handle 30, as oriented and depicted in FIG. 6, extends in the second direction which is parallel to the forearm 10 of the user. When not using the apparatus 600 as a forearm 10 support, the user may simply carry the cargo in his hand by gripping the handle 157 of the securing member 150, which is oriented in the first direction, instead of carrying the cargo by the cargo handle 30, which is oriented in the second direction.

Figure 7:
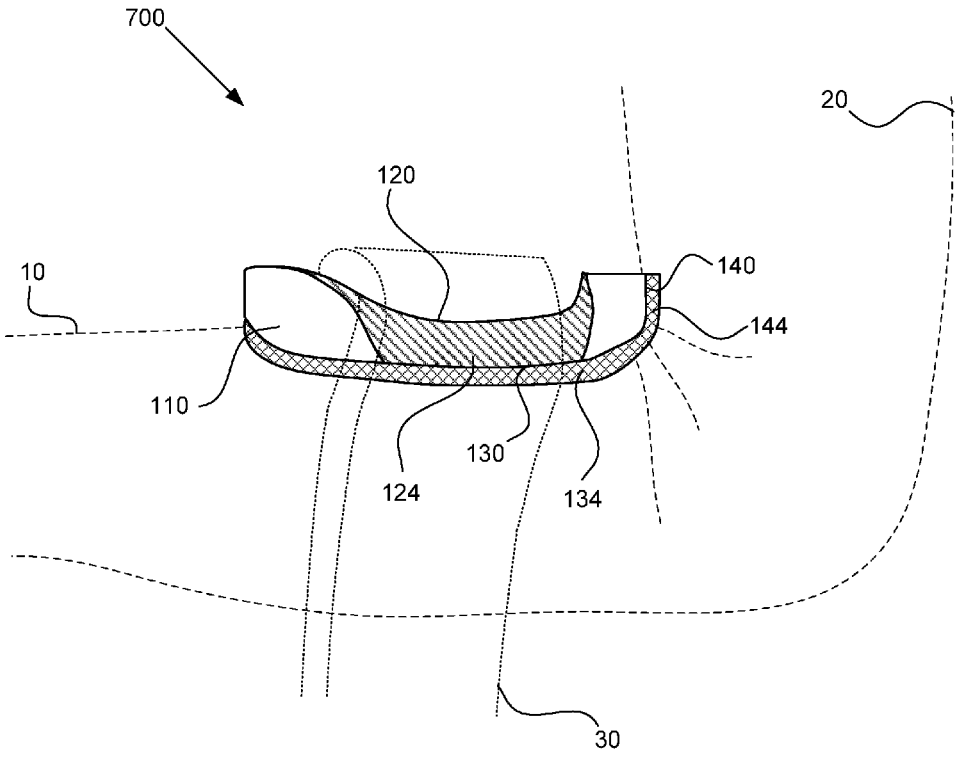
FIG. 7 is a side view illustrating yet another embodiment of an apparatus for supporting a cargo handle on the forearm of a user.

FIG. 7 is a side view illustrating yet another embodiment of an apparatus for supporting a cargo handle on the forearm of a user. Some numbered elements depicted in FIG. 7 are not explicitly described below and were described above with reference to the previously presented Figures. Such elements are included in the present Figure for clarity in understanding the relative positions and configurations of the various components. FIG. 7 depicts and apparatus 700 that does not include a securing member. In such an embodiment, the apparatus 700 simply includes a base member 110 that supports the cargo handle 30 on an upper surface 120 and engages the forearm 10 of a user on the lower surface 130. Additionally, the apparatus, although depicted with a proximal vertical surface 140, may not include the proximal vertical surface 140 and may simply be implemented as a base member 110 operably positioned between the cargo handle 30 and the forearm 10 of a user.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

The subject matter of the present disclosure may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. An apparatus that rests on a forearm of a user and supports a cargo handle, a longitudinal axis of the forearm extending in a first direction and the cargo handle extending in a second direction substantially perpendicular to the first direction, the apparatus comprising:

a base member positionable between the cargo handle and forearm;

an upper surface defined by the base member, the upper surface comprising a concave handle reception recess; and a lower surface defined by the base member, the lower surface being concave and curved about first axis that is substantially parallel to the first direction when the lower surface is engaged with the forearm of the user;

wherein the concave handle reception recess is curved about a second axis that is substantially perpendicular to the first direction when the lower surface is engaged with the forearm of the user.

2. The apparatus of claim 1, wherein the lower surface comprises a lining material.

3. The apparatus of claim 1, wherein the lining material comprises a cushioning material.

4. The apparatus of claim 1, wherein the handle reception recess comprises at least one of a grip-enhancing material and grip-enhancing features.

5. The apparatus of claim 1, wherein the handle reception recess is contoured to receive and retain the cargo handle.

6. The apparatus of claim 1, wherein the lower surface is elongate in a direction parallel to the axis.

7. The apparatus of claim 1, further comprising a proximal vertical surface defined by the base member, the proximal vertical surface being curved about an axis parallel to a longitudinal axis of an upper arm of the user coupled to the forearm of the user.

8. The apparatus of claim 7, wherein the proximal vertical surface further comprises a lining material.

9. The apparatus of claim 1, further comprising a securing member coupled to the base member, wherein at least a portion of the securing member spans over the upper surface of the base member.

10. The apparatus of claim 9, wherein the securing member comprises means for releasably securing the securing member to the cargo handle.

11. The apparatus of claim 9, wherein the base member and the securing member comprise means for releasably securing the apparatus about the cargo handle.

12. The apparatus of claim 9, wherein the securing member comprises at least one of a grip-enhancing material and grip-enhancing features.

13. The apparatus of claim 9, wherein the securing member comprises a first end rotatably coupled to the base member and a second end detachably coupleable to the base member.

14. The apparatus of claim 9, wherein the securing member comprises a handle extending at least partially across the handle reception recess.

15. The apparatus of claim 9, wherein the securing member comprises a strap with a first end portion coupled to the base member at a first location and a second end portion removably coupled to the base member at a second location, the first and second locations being on opposing sides of the handle reception recess.

16. The apparatus of claim 1, wherein the apparatus is integrated into the cargo handle to form a one-piece monolithic construction with the cargo handle.

17. The apparatus of claim 1, further comprising a user handle extending from the base member.

18. An apparatus that rests on the forearm of a user and supports a cargo handle, a longitudinal axis of the forearm extending in a first direction and the cargo handle extending in a second direction substantially perpendicular to the first direction, the apparatus comprising:

a non-flexible base member positionable between the cargo handle and forearm;

an upper surface defined by the base member, the upper surface comprising a handle reception recess;

a lower surface defined by the base member, the lower surface being curved about an axis that is substantially parallel to the first direction when engaged with the forearm of the user;

a proximal vertical surface defined by the base member, the proximal vertical surface being curved about an axis substantially parallel to a longitudinal axis of an upper arm coupled to the lower arm of the user when engaged with the upper arm of the user; and a securing member attached to the base member, wherein at least a portion of the securing member is elevated above and spaced apart from the upper surface of the base member by at least a thickness of the cargo handle.

19. The apparatus of claim 17, wherein the securing member rotates relative to the base member to secure the cargo handle between the securing member and the handle reception recess.

20. A method for retrofitting a cargo handle to be carried by a forearm of a user, comprising:

providing a forearm apparatus comprising a base member with an upper surface defining a concave handle reception recess and a lower surface defining a concave forearm reception recess, the concave handle reception recess being contoured to receive the cargo handle and the concave forearm reception recess being contoured to receive the forearm of a user, the apparatus further comprising a clamping member movably coupled to the base member;

positioning the forearm apparatus onto the forearm of the user such that the forearm of the user is received within the concave forearm reception recess; and with the forearm of the user received within the concave forearm reception recess, removably securing the forearm apparatus to the cargo handle by positioning the cargo handle into the concave handle reception recess such that the cargo handle extends perpendicular to the forearm, and with the cargo handled extended perpendicular to the forearm, moving the clamping member to clamp the cargo handle between the clamping member and the concave handle reception recess.

* * * * *